US005310112A

United States Patent [19]

Meshberg

[11] Patent Number: 5,310,112

[45] Date of Patent: May 10, 1994

[54] VALVED GASKET FOR DISPENSER

[76] Inventor: Philip Meshberg, 2500 S. Ocean Blvd. Building 3, Apt. 1-A, Palm Beach, Fla. 33480

[21] Appl. No.: 846,631

[22] Filed: Mar. 5, 1992

[51] Int. Cl.[5] ..... B67D 3/00

[52] U.S. Cl. ..... 222/482; 137/493.8; 222/212; 222/490; 222/494

[58] Field of Search ..... 222/206, 212, 215, 481.5, 222/482, 490, 491, 494; 137/493.8, 606, 895

[56] References Cited

U.S. PATENT DOCUMENTS

| | | | |
|---|---|---|---|
| 1,972,344 | 9/1934 | Jackson | 222/494 |
| 3,176,883 | 4/1964 | Davis, Jr. | 222/482 X |
| 3,319,836 | 5/1967 | Cubitt | 222/494 X |
| 3,360,169 | 12/1967 | Susuki et al. | 222/494 X |
| 3,858,773 | 1/1975 | Del Bon | 222/494 |
| 4,057,177 | 11/1977 | Laauwe | 222/481.5 X |
| 4,159,790 | 7/1979 | Bailey | 222/211 |
| 4,506,809 | 3/1985 | Corsette | 222/494 X |
| 4,615,467 | 10/1986 | Grogan et al. | 222/189 |
| 4,646,945 | 3/1987 | Steiner et al. | 222/207 |
| 4,760,937 | 8/1988 | Evezich | 222/95 |
| 4,846,376 | 7/1989 | Palmer | 222/190 |
| 5,048,750 | 9/1991 | Tobler | 222/212 X |
| 5,099,885 | 3/1992 | Nilsson | 222/494 X |

*Primary Examiner*—Andres Kashnikow
*Assistant Examiner*—J. A. Kaufman
*Attorney, Agent, or Firm*—Kenyon & Kenyon

[57] ABSTRACT

A valving gasket is disclosed for a squeeze bottle sprayer. The gasket includes upper and lower gaskets, each having a vent hole and a flap valve. The vent hole on the upper gasket cooperates with the flap valve on the lower gasket, and the vent hole on the lower gasket cooperates with the flap valve on the upper gasket. The result is that two valved vent paths are created—one for incoming air and one for outgoing air. The incoming air is used to fill the dispenser after squeezing, to equalize pressure in the bottle. The outgoing air is directed through a vent path to a spray chamber and is intermingled with outgoing liquid to create a fine mist spray pattern. The outgoing air vent is small enough to allow escaping air but to prevent exhausting of all pressure during squeezing. The outgoing air flap valve prevents leakage through the outgoing air hole when the bottle is inverted. The upper gasket may also have a flap valve for the outgoing liquid. There is also disclosed a key-keyway arrangement for assisting in assembly of the gaskets so that the valves and holes align.

24 Claims, 2 Drawing Sheets

VALVED GASKET FOR DISPENSER

BACKGROUND OF THE INVENTION

The invention relates to venting arrangements for dispensing bottles, and specifically to a sealing gasket for a squeeze bottle dispenser which includes venting valves.

There are several different techniques for dispensing a fluid substance in a fine mist. One technique is to provide a resilient dispensing bottle with an outlet orifice such that as the bottle is squeezed by a user, pressure builds up within the container. The pressure in the container forces any liquid within the container out a dispensing orifice, which can be structured to produce a fine mist of liquid. Often, however, it is difficult to arrive at a particularly fine mist in such a dispenser solely through the use of a shaped orifice. Furthermore, the conventional means for providing an outlet valve—a ball valve—is generally expensive to manufacture, thus increasing the cost of the dispenser to the end user.

A technique used to eliminate some of the above disadvantages is disclosed in U.S. Pat. No. 5,183,186, which is incorporated herein by reference. In this invention, a squeeze bottle has a liquid flow path and an air flow path. When the bottle is squeezed, liquid is transmitted through the liquid flow path and pressurized air through the air flow path. These two flows meet in a mixing chamber which is located adjacent an outlet orifice. The air and liquid mix to form a fine spray. The disadvantage of this arrangement is that it requires the use of a relatively expensive ball valve for the liquid outlet, and liquid will leak out of the dispenser when the bottle is inverted, because the air path is completely open to fluid flow.

SUMMARY OF THE INVENTION

The drawbacks of the above described arrangement are overcome by the apparatus of the present invention. In the present invention, a special valved gasket arrangement is provided which provides several advantageous features. The gasket arrangement has a centrally located flap valve, which is used in place of the conventional ball valve for the outlet. This reduces the cost of manufacture of the dispenser. The gasket arrangement also includes a one-way flap valve for inlet air into the dispensing bottle. This valve allows the dispenser to vent properly, while still allowing a pressure build-up in the bottle during squeezing. Finally, the gasket arrangement includes another one-way flap valve for outlet air from the dispensing bottle. This outlet air is used to intermingle with the dispensed liquid to produce a desirable fine mist. The outlet valve is configured such that it allows only a certain amount of outlet air, so as not to prevent squeeze-actuated dispensing. The valve is also configured to respond to only a certain threshold pressure level, so that it will open during squeeze-induced pressurization, but it will not open when the dispenser is in an inverted position. This allows proper dispensing, and still prevents leakage when the bottle is not in an upright position. The gasket also functions to seal the bottle from leakage.

DETAILED DESCRIPTION

Figure 1:
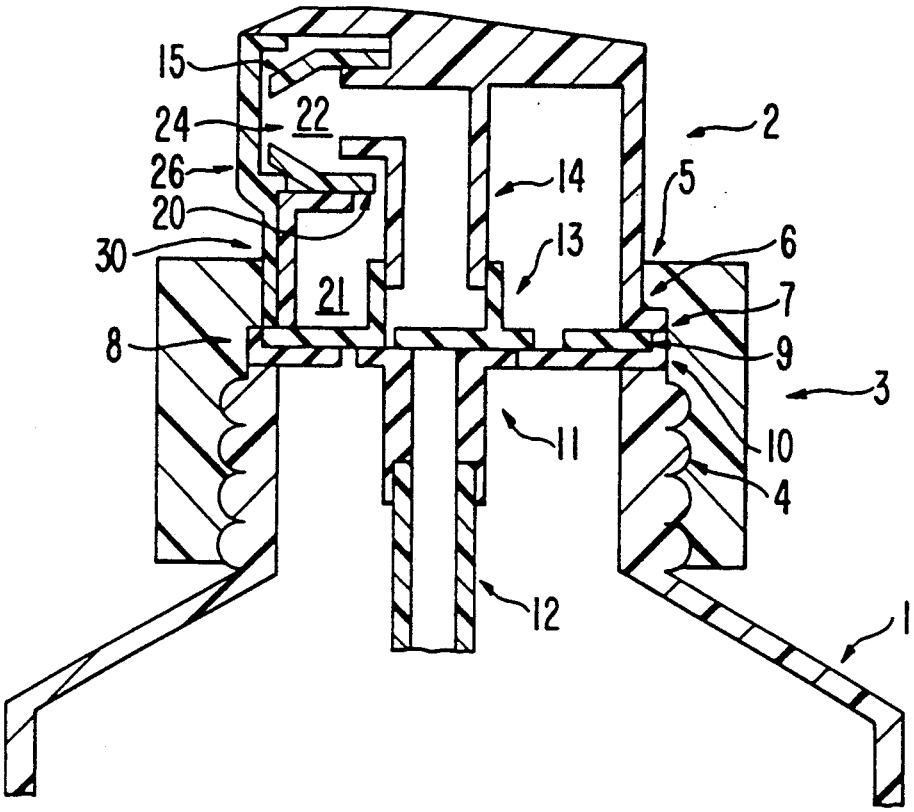
FIG. 1 is cross-sectional view of a dispensing bottle including a gasket structure of the instant invention.

As illustrated in FIG. 1, the instant invention is directed towards a valving structure for a squeeze bottle dispenser. The dispenser includes a bottle 1, a dispensing housing 2, and housing mounting cap 3. Bottle 1 is constructed of a resilient material. The neck of bottle 1 is threaded, and cooperates with threads 4 on housing mounting cap 3. Mounting cap 3 has a centrally located hole 5 and flange 6 which cooperate with housing 2 and housing flange 7 to secure housing 2 to bottle 1 when the cap 3 is screwed onto the neck of bottle 1.

Captured between the top of bottle 1 neck and the bottom of flange 7 is a gasket arrangement 8. Gasket arrangement 8 consists of upper gasket member 9 and lower gasket member 10. Lower gasket member 10 has a centrally located annular projection 11 designed to sealingly engage and hold a dip tube 12. Upper gasket member has a centrally located annular projection 13 which sealingly engages a fluid passage 14 in housing 2. The end of fluid passage 14 opposite the annular projection 13 leads to a dispensing nozzle 15, which can be a separate unit inserted into housing 2. Housing 2 also has a vent path 20 connecting a vent chamber 21 in housing 2 with a spray chamber 22 in housing 2.

Upper gasket member 9 includes a flap valve 16 and a vent hole 17. Lower gasket member 10 includes a vent hole 18 opposite from and cooperating with flap valve 16. Lower gasket member 10 also includes a flap valve 19 opposite from and cooperating with vent hole 17. Upper gasket member 9 may also include an outlet flap valve 23 separating dip tube 12 from fluid passage 14. Alternatively, a ball valve could be used in place of outlet flap valve 23.

Figure 2:
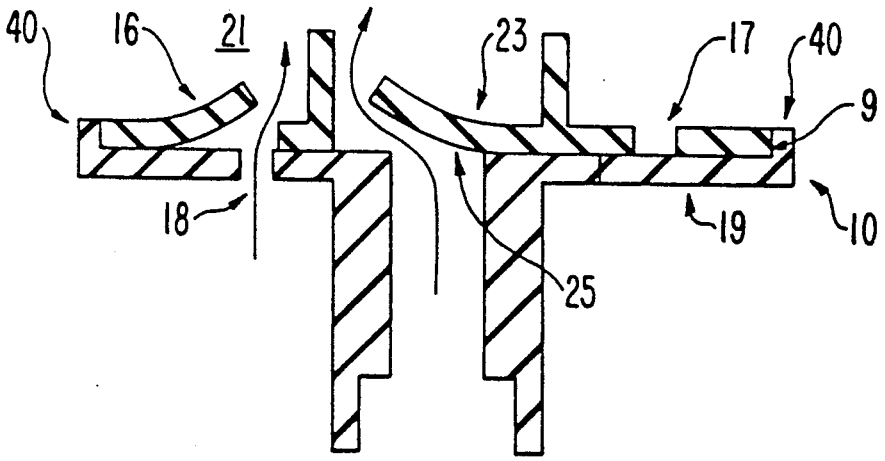
FIG. 2 is a cross-sectional view of the gasket structure of the present invention, showing the position of the valves during squeezing.

In operation, the bottle 1 is filled with a fluid to be dispensed through the bottle 1 neck, and the housing 2 is attached to bottle 1 by means of cap 3. As shown in FIG. 2, when liquid product is to be dispensed, a user squeezes the sides of bottle 1, thus increasing the pressure within bottle 1. Increased pressure in bottle 1 causes flap valve 19 to be forced against the part of upper gasket member 9 surrounding vent hole 17, thus closing off vent hole 17. At the same time, increased pressure causes air in the upper portion of bottle 1 to escape out of vent hole 18. This air pushes against, and opens, flap valve 16. Vent hole 18 is designed to be of a small enough size so that although it allows some air to escape out of the bottle 1, it does not exhaust all of the pressure increase in bottle 1. The pressure in bottle 1 also causes the fluid in the bottle to be forced up dip tube 12, unseating valve 23. Fluid continues to flow through passage 14 and into spray chamber 22. Air escaping through flap valve 16 passes through vent chamber 21 and vent path 20. Accordingly, pressurized fluid enters spray chamber 22 from passage 14, while pressurized air enters spray chamber 22 from vent path 20. The pressurized fluid and air combine in spray chamber 22 and exit through a nozzle orifice 24 in such a way that a fine mist of fluid is discharged through orifice 24.

Figure 3:
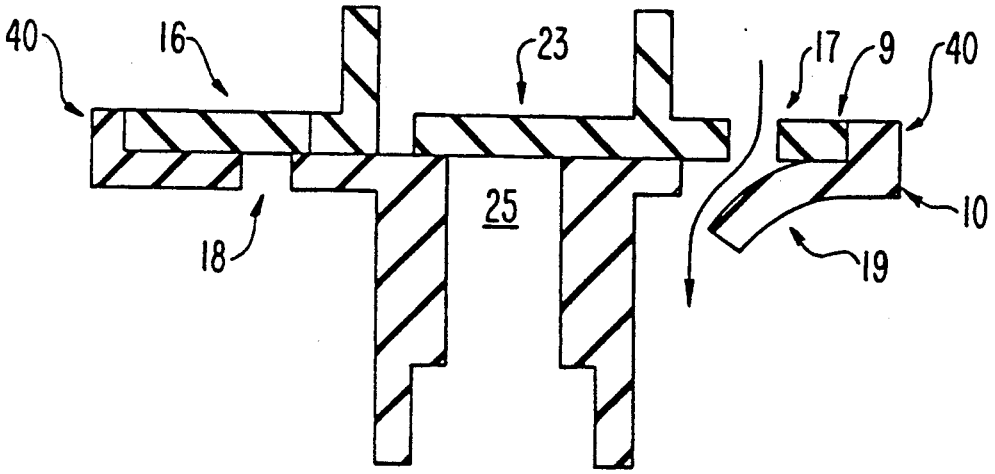
FIG. 3 is a cross-sectional view of the gasket structure of the present invention, showing the position of the valves during venting.

After squeezing pressure is released, the resiliency of bottle 1 causes the sides of bottle 1 to expand, thus decreasing the pressure within bottle 1 relative to atmospheric pressure. As shown in FIG. 3, this relative pressure difference causes outlet valve 23 to close against the portion of lower gasket member 10 surrounding outlet passage 25. Furthermore, the relative pressure also acts to close flap valve 16 against the portion of lower gasket member 10 surrounding vent hole 18. In contrast, the relative pressure difference acts to cause air to flow through vent hole 17 and to open flap valve 19 such that exterior air is vented into the interior of bottle 1. Air continues to enter through flap valve 19 until the resiliency of bottle 1 has caused it to resume its original shape.

Flap valve 16 is designed to be of sufficient resiliency such that it will not open due to the fluid pressure against it caused by inversion of bottle 1. Accordingly, when the bottle is inverted, fluid will not leak out vent hole 18 to vent path 20 and out orifice 24. However, flap valve 16 is designed so that it will open when sufficient force is applied to bottle 1 during a dispensing operation, such that pressurized air can escape through flap valve 16 to allow the escaping air to generate a fine mist in spray chamber 22. If flap valve 23 is used in place of a ball valve, it is constructed similar to flap valve 16. Thus, flap valve 23 has sufficient resiliency such that it will not open due to fluid pressure against it when the bottle 1 is inverted. Flap valve 23 will, however, open in response to fluid pressure on it caused by squeezing of bottle 1.

Preferably, upper gasket member 9 and lower gasket member 10 are constructed of a relatively resilient substance, for example an elastomer. Resiliency allows the gasket members to seal the bottle 1 neck against the housing 3 to prevent leakage, and allows flap valves 16 and 19 to operate in the manner described above. Upper gasket member 9 can also include an attached hinged sealing member 26 which can swing about hinge 30 into engagement with nozzle 15 to seal it against the incursion of air and dirt, as well as providing an added degree of leakproofing beyond flap valve 16.

Figure 4:
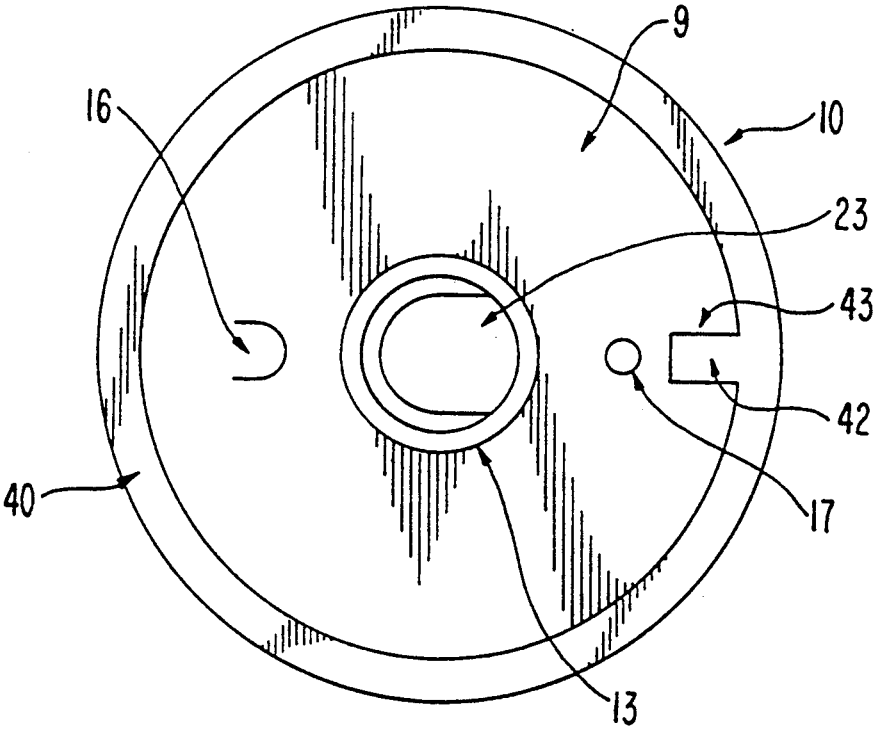
FIG. 4 is a top view of the gasket structure of the present invention, showing the arrangement for assembly.

FIG. 4 shows an arrangement for assembling the gasket arrangement 8. Because it is necessary that the flap valves 16 and 19 are aligned with the holes 17 and 18, it is desirable to have an arrangement which makes such alignment easy during an assembly operation. In the preferred embodiment, this is done by having an upstanding annular ridge 40 on lower gasket 10. This ridge 40 allows the upper gasket 9 to be nested within the ridge, so that the two gaskets 9 and 10 are connected together. To ensure that the flap valves 16 and 19 are aligned with the holes 17 and 18, there are one or more keys 42 on ridge 40 which engage keyways 43 in gasket 9. By engaging key 42 in keyway 43, it is ensured that the gaskets 9 and 10 have the proper angular orientation relative to one another, and thus that the holes 17 and 18 are properly aligned with the valves 16 and 19.

What is claimed is:

1. A valving arrangement for a dispenser comprising:

an upper member with a hole and a flap valve;

a lower member with a hole and a flap valve;

said upper member overlaying said lower member;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one being shaped so as to allow air flow in one direction and one being shaped so as to allow limited air flow in an opposite direction; and an additional liquid flow passage through said upper and lower members for allowing liquid flow from said container in said one direction.

2. The valving arrangement of claim 1, wherein:

said upper and lower members are constructed of a resilient material.

3. A dispensing unit for a fluid container comprising:

a dispensing head, said dispensing head including two passageways and a dispensing orifice, said two passageways leading to said dispensing orifice;

an upper venting member connected to the underside of said dispensing head, said upper venting member comprising at least one hole and at least one flap valve; and a lower venting member connected to the underside of said upper venting member, said lower venting member comprising at least one hole and at least one flap valve, said at least one hole on said upper venting member being aligned with said at least one flap valve on said lower venting member so as to allow air flow from one of said passageways to said fluid container, and said at least one flap valve on said upper venting member being aligned with said at least one hole on said lower venting member so as to allow air flow from said fluid container to said one of said passageways.

4. The dispensing unit of claim 3, wherein:

said upper venting member is a resilient gasket.

5. The dispensing unit of claim 3, wherein:

said lower venting member is a resilient gasket.

6. The dispensing unit of claim 3, wherein:

said upper venting member and said lower venting members include fluid flow passages cooperating with one another to allow fluid flow from said container to the other of said passageways.

7. The dispensing unit of claim 6, wherein:

said fluid flow passages are in fluid communication with a conduit extending below the level of said hole in said lower venting member.

8. The dispensing unit of claim 3, wherein:

said upper venting member includes a second flap valve;

said lower venting member includes a second hole; and said second flap valve is aligned with said second hole to allow fluid flow from said fluid container to the other of said passageways.

9. The dispensing unit of claim 8, wherein:

said second hole is in fluid communication with a conduit extending below the level of said hole in said lower venting member.

10. The dispensing unit of claim 3, wherein:

said passageways meet in a spray chamber adjacent to, and in fluid communication with, said dispersing orifice.

11. The dispensing unit of claim 10, wherein:

said upper venting member and said lower venting members further comprise fluid flow passages cooperating with one another to allow fluid flow from said container to the other of said passageways.

12. The dispensing unit of claim 11, wherein:

said fluid flow passages are in fluid communication with a conduit extending below the level of said hole in said lower venting member, wherein air passes through said one of said passageways, and liquid passes through said other of said passageways.

13. The dispensing unit of claim 3, wherein:

one of said venting members has an upstanding ridge which encircles the other of said venting members to retain said venting members together.

14. The dispensing unit of claim 3, wherein:

one of said venting members has a projection which cooperates with a recess in the other of said venting members to align said holes and said flap valves.

15. A valving arrangement for a dispenser comprising:

an upper member with a hole, a flap valve and a centrally located flap valve;

a lower member with a hole and a flap valve and a centrally located hole;

said upper member overlaying said lower member;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one for air flow in one direction and one for limited air flow only in an opposite direction, and wherein said centrally located flap valve is aligned with said centrally located hole so as to form a one-way valve for fluid flow.

16. A valving arrangement for a dispenser comprising:

an upper member with a hole and a flap valve;

a lower member with a hole and a flap valve, said lower member further comprising an annular projection for cooperating with a fluid conveying tube in the interior of said dispenser;

said upper member overlaying said lower member;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one for air flow in one direction and one for limited air flow only in an opposite direction.

17. The valving arrangement of claim 16, wherein:

said upper member further comprises an annular projection for cooperating with a fluid dispensing passage leading to a dispersing nozzle.

18. A valving arrangement for a dispenser comprising:

an upper member with a hole and a flap valve;

a lower member with a hole and a flap valve;

said upper member overlaying said lower member, said upper member including a hinged sealing member for cooperating with and sealing a dispensing orifice;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one for air flow in one direction and one for limited air flow only in an opposite direction.

19. A valving arrangement for a dispenser comprising:

an upper member with a hole and a flap valve;

a lower member with a hole and a flap valve;

said upper member overlaying said lower member;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one for air flow in one direction and one for limited air flow only in an opposite direction, and wherein one of said members has an upstanding ridge which encircles the other of said members to retain said members together.

20. A valving arrangement for a dispenser comprising:

an upper member with a hole and a flap valve;

a lower member with a hole and a flap valve;

said upper member overlaying said lower member;

said hole on said upper member being aligned with said flap valve on said lower member and said hole on said lower member being aligned with said flap valve on said upper member;

wherein said hole on said upper member cooperates with said flap valve on said lower member and said hole on said lower member cooperates with said flap valve on said upper member so as to respectively form two one-way valves, one for air flow in one direction and one for limited air flow only in an opposite direction, and wherein one of said members has a projection which cooperates with a recess in the other of said members to align said holes and said flap valves.

21. A dispenser comprising:

a fluid container; and a dispensing unit attached to an open end of said fluid container;

said dispensing unit including:

a dispensing head with two passageways and a dispensing orifice; and a venting member between said dispensing head and said fluid container;

said venting member including:

a first resilient valve for allowing air to flow from a first of said two passageways to said container;

a second resilient valve for allowing air to flow from an upper portion of said container to said first of said passageways, said second valve having sufficient resiliency so as not to open when said container is inverted when filled with fluid; and a conduit for allowing liquid to flow from a lower portion of said container to a second of said two passageways.

22. A dispenser comprising:

a fluid container; and a dispensing unit attached to an open end of said fluid container;

said dispensing unit including:

a dispensing head with two passageways and a dispensing orifice; and a venting member between said dispensing head and said fluid container;

said venting member comprising upper and lower gaskets and including:

a first flap valve for allowing air to flow from a first of said two passageways to said container;

a second flap valve for allowing air to flow from an upper portion of said container to said first of said passageways, said two passageways meeting in a chamber in fluid communication with said dispensing orifice; and a conduit for allowing liquid to flow from a lower portion of said container to a second of said two passageways.

23. The dispenser of claim 22, wherein:

one of said gaskets has an upstanding ridge which encircles the other of said gaskets to retain said gaskets together.

24. The dispenser of claim 22, wherein:

one of said gaskets has a projection which cooperates with a recess in the other of said gaskets to align said flap valves with respective holes on said gaskets.

* * * * *